United States Patent [19]

Orbanic

[11] Patent Number: 4,701,140

[45] Date of Patent: Oct. 20, 1987

[54] ELECTRICAL CONNECTOR WITH COMPLIANT SECTION

[75] Inventor: Robert S. Orbanic, Warren, Pa.

[73] Assignee: GTE Products Corporation, Stamford, Conn.

[21] Appl. No.: 889,723

[22] Filed: Jul. 28, 1986

[51] Int. Cl.[4] ..... H01R 13/428; H01R 13/41

[52] U.S. Cl. ..... 439/751; 439/873

[58] Field of Search ..... 339/17 C, 220 R, 221 R, 339/221 M, 252 R, 252 P; 439/82, 743, 751, 825, 826, 827, 873

[56] References Cited

U.S. PATENT DOCUMENTS

| | | | |
|---|---|---|---|
| 3,634,819 | 1/1972 | Evans | 339/221 R |
| 3,764,955 | 10/1973 | Ward | 339/220 R |
| 3,824,554 | 7/1974 | Shoholm | 339/252 P |
| 4,089,580 | 5/1978 | Huffnagle et al. | 339/99 R |
| 4,533,204 | 8/1985 | Moynagh, Jr. et al. | 339/221 R |

*Primary Examiner*—Gil Weidenfeld
*Assistant Examiner*—Gary F. Paumen
*Attorney, Agent, or Firm*—William H. McNeill

[57] ABSTRACT

A press-fit connector has a compliant portion formed as a fusiform, laterally bifurcated tube having two oppositely disposed "C" shaped sections for engaging the surface area of a plated-through-hole in a printed circuit board.

4 Claims, 5 Drawing Figures

ELECTRICAL CONNECTOR WITH COMPLIANT SECTION

TECHNICAL FIELD

This invention relates to electrical connectors and more particularly to such connectors having a compliant section. Still more particularly, it relates to such connectors for insertion into plated through holes in printed circuit boards.

BACKGROUND ART

Modern electronic apparatus makes extensive use of printed circuit boards employing plated through holes (PTH). As an alternative to soldering connectors in these holes, it has been proposed to use connectors which engage the hole by friction only. Such connectors generally employ a compliant section for engagement to provide good mechanical and electrical contact. It is desirable that minimum damage be done to the PTH so that such connectors can be removed and replaced. The compliant connectors generally available take several forms: the "eye-of-the-needle" approach, as shown in U.S. Pat. Nos. 3,545,080; 3,634,819; and 4,206,964: the "split beam" approach, shown in U.S. Pat. Nos. 4,066,326; 4,186,982; and 4,443,053: and the "C" section, as shown in U.S. Pat. No. 4,076,356. Another technique has utilized a straight pin having a quadrangular PTH engaging section whose diagonal exceeds the PTH diameter. The latter approach causes considerable damage to the plating and is not suitable for many applications.

While some of the techniques work to a greater or lesser extent, all have one or more problems, such as cost of making; failure to form a good gas tight seal with the PTH; difficulty with insertion; or difficulty of removal.

DISCLOSURE OF THE INVENTION

It is, therefore, an object of the invention to obviate the disadvantages of the prior art.

It is another object of the invention to enhance electrical connection in plated through holes.

Yet another object of the invention is the provision of an electrical connector for PTH's which achieves the above objects and, additionally, provides ease of insertion and removal with minimal plating damage.

These objects are accomplished, in one aspect of the invention, by the provision of an electrical connector which comprises a body having a longitudinal axis with first and second spaced apart, substantially rigid portions. These portions are separated by and joined to a compliant portion formed as a fusiform, laterally bifurcated tube which provides two oppositely disposed "C" shaped segments symmetrically arrayed about the longitudinal axis. Each of the segments has a first thickness adjacent the ends thereof and a second thickness at the center thereof, the second thickness being greater than the first thickness.

This connector provides good electrical and mechanical contact by engaging a substantial amount of the surface area of the PTH; i.e., more than 50% of such area. The fusiform section provides easy entry and the thickened center section provides mechanical strength.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
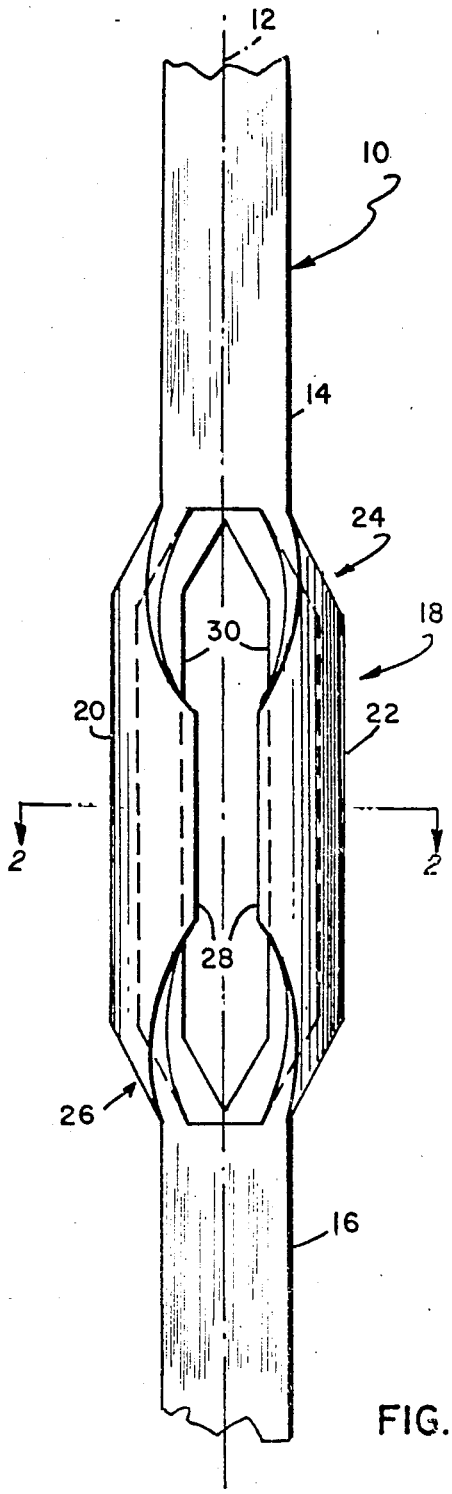
FIG. 1 is an elevational view of an embodiment of the invention.

Referring now to the drawings with greater particularity, there is shown in FIG. 1 an electrical connector 10 having a longitudinal axis 12. Connector 10 has a first end 14 and a second end 16 which are substantially rigid and spaced apart. These ends may take, at their functional terminations, any desired form. For example, first end 14 may be formed to contact a printed circuit board and second end 16 may be formed as a wire wrap terminal.

The spaced apart first and second ends are separated by and joined to a compliant portion 18 which is formed as a fusiform, laterally bifurcated tube having two oppositely disposed "C" shaped segments 20 and 22, symmetrically arrayed about the longitudinal axis 12. (See FIG. 2) The tapered ends 24 and 26 blend smoothly into the first and second ends, 14 and 16, respectfully.

Figure 2:
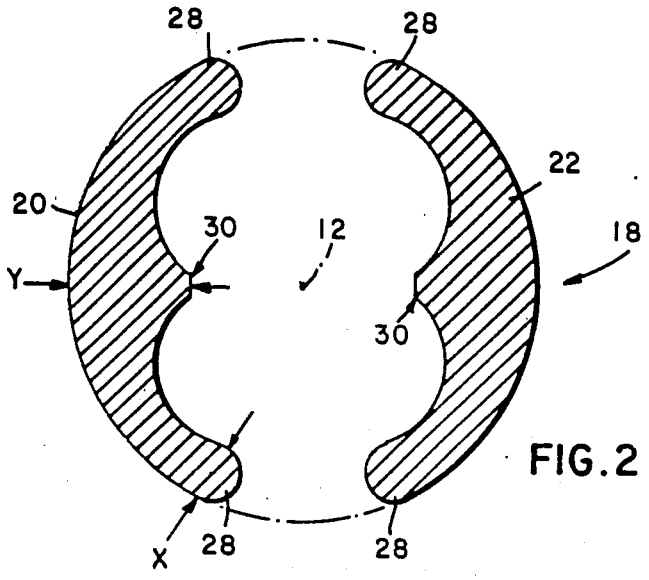
FIG. 2 is a sectional view taken along the line 2—2 of FIG. 1.

The "C" shaped segments 20 and 22 have a first thickness, indicated as "x" in FIG. 2, adjacent the ends 28 thereof, and a second, greater thickness "y", substantially at the center 30 thereof. The configuration of the center 30, in cross-section, is substantially frustoid.

The first and second ends 14 and 16 may be any desirable cross-section; however, square is preferred. In a preferred embodiment the connector 10 is made from 0.025" square wire. A suitable material is phosphor bronze. The diameter of the compliant section 18 is 0.046", for insertion into a 0.040" PTH.

Figure 3:
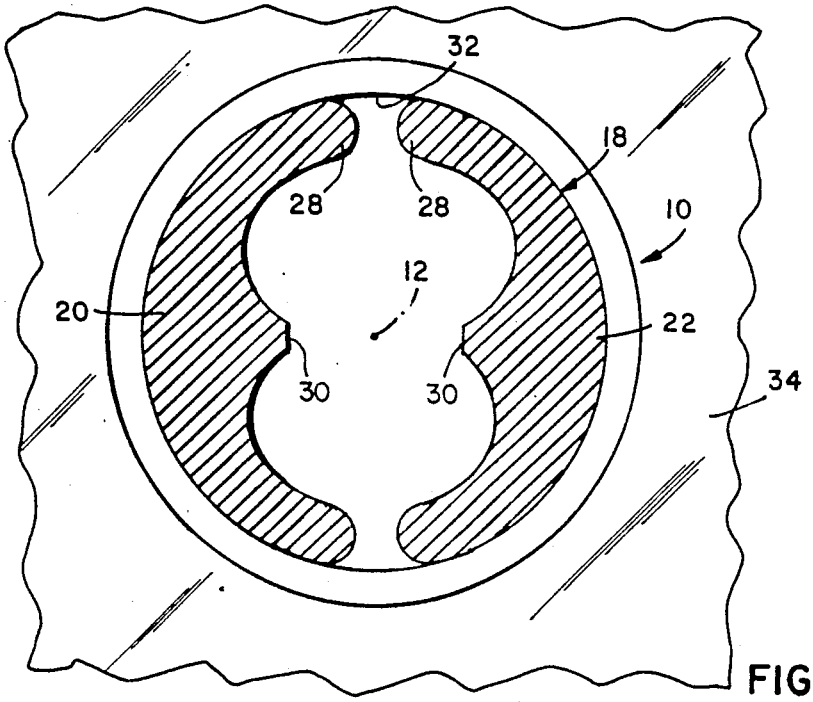
FIG. 3 is a view similar to FIG. 2 showing the connector inserted in a PTH.

FIG. 3 shows connector 10, particularly compliant portion 18, inserted into a PTH 32 formed in a printed circuit board 34, and illustrates the substantially even compression of the "C" sections and good electrical and mechanical contact with the PTH 32.

Figure 4:
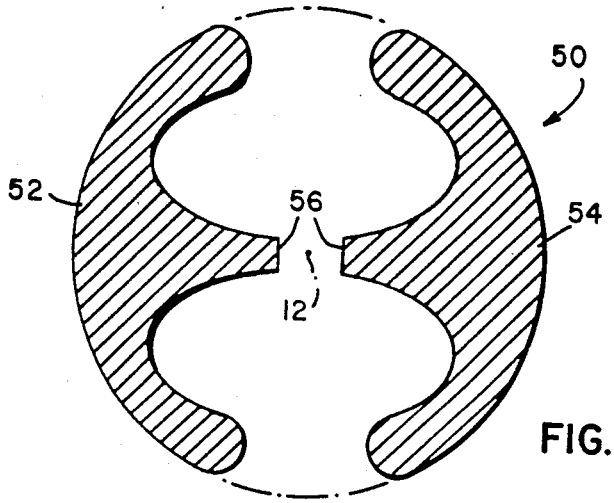
FIGS. 4 and 5 are views similar to FIGS. 2 and 3 illustrating an alternate construction.
Figure 5:
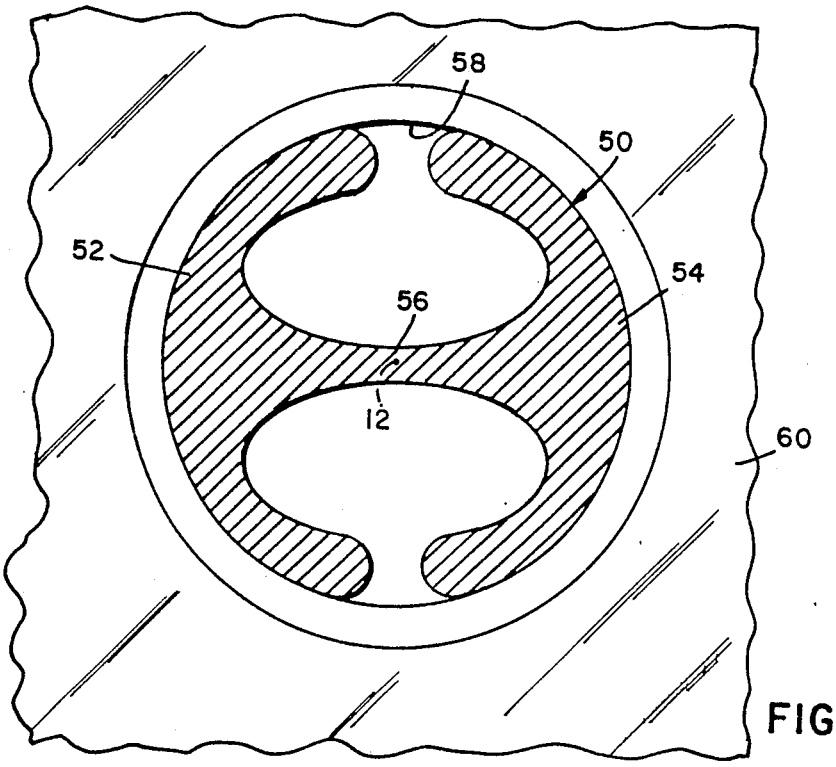

FIGS. 4 and 5 illustrate an alternate construction with a compliant portion 50 wherein the "C" shaped segments 52 and 54 have centers 56 which extend much closer to axis 12 than centers 30 in the previous embodiment. In this case, upon insertion into a PTH 58 in a board 60 (FIG. 5), the centers 56 will contact one another and may even buckle slightly. Such a construction results in even greater retention pressure.

Connectors made in accordance with the teachings herein greatly enhance the art of press-fit connectors. They are simple and economical to fabricate; are easy to insert and remove; cause minimal damage to plated-through-holes; and provide good electrical and mechanical contact.

While there have been shown and described what are at present considered to be the preferred embodiments of the invention, it will be apparent to those skilled in the art that various changes and modifications can be made herein without departing from the scope of the invention as defined by the appended claims.

I claim:

1. An electrical connector comprising: a body having a longitudinal axis with first and second spaced apart, substantially rigid portions separated by and joined to a compliant portion formed as a fusiform, laterally bifurcated tube providing two oppositely disposed substantially C shaped segments symmetrically arrayed about a line normal to said longitudinal axis; said substantially C shaped segments each having a first given thickness adjacent the ends thereof and a second given thickness substantially at the center thereof, said second given thickness being greater than said first given thickness and extending substantially the entire length of said substantially C-shaped segment.

2. The electrical connector of claim 1 wherein said second given thickness is substantially frustoid in cross-section.

3. The electrical connector of claim 2 wherein said first and second sections are quadrangular in cross-section.

4. The electrical connector of claim 3 wherein said first and second sections are square in cross-section.

* * * * *